US006453868B1

(12) United States Patent
McClure

(10) Patent No.: US 6,453,868 B1
(45) Date of Patent: Sep. 24, 2002

(54) ENGINE TIMING GEAR COVER WITH INTEGRAL COOLANT FLOW PASSAGES

(75) Inventor: Samuel Aaron McClure, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/738,822

(22) Filed: Dec. 15, 2000

(51) Int. Cl.[7] ..... F02F 7/00
(52) U.S. Cl. ..... 123/195 C
(58) Field of Search ..... 123/195 C, 41.44, 123/41.08, 41.47, 198 C

(56) References Cited

U.S. PATENT DOCUMENTS

| | | | | |
|---|---|---|---|---|
| 1,461,711 A | | 7/1923 | Bull | |
| 2,353,231 A | | 7/1944 | Ginn | 123/195 |
| 2,792,820 A | | 5/1957 | Leach | 123/195 |
| 2,852,009 A | | 9/1958 | Turlay | 123/41.1 |
| 4,155,333 A | | 5/1979 | Maggiorana | 123/41.44 |
| 4,448,159 A | | 5/1984 | Hidaka et al. | 123/195 C |
| 4,662,320 A | | 5/1987 | Moriya | 123/41.44 |
| 4,686,942 A | * | 8/1987 | Hayashi et al. | 123/41.21 |
| 4,938,185 A | | 7/1990 | Doke | 123/195 C |
| 5,148,784 A | | 9/1992 | Hiraoka et al. | 123/195 C |
| 5,188,065 A | | 2/1993 | Lyndhurst et al. | 123/41.44 |
| 5,279,265 A | | 1/1994 | Matsuo et al. | 123/41.44 |

* cited by examiner

*Primary Examiner*—Gene Mancene
*Assistant Examiner*—Hyder Ali

(57) ABSTRACT

A engine having a timing gear cover with integrally formed coolant inlet and discharge fittings for connection to a radiator. The cover forms a water pump inlet chamber and a water pump outlet chamber defined by the walls of the cover and the front face of the engine block. The lower pressure water pump inlet chamber separates the higher pressure water pump outlet chamber from a timing gear chamber to prevent coolant leakage from the water pump inlet chamber into the timing gear chamber where the lubricating oil will be contaminated. The water pump housing also includes a drain fitting for draining coolant from the engine.

15 Claims, 3 Drawing Sheets

ENGINE TIMING GEAR COVER WITH INTEGRAL COOLANT FLOW PASSAGES

BACKGROUND AND SUMMARY OF THE INVENTION

1. Field of the Invention

The present invention relates to an internal combustion engine and in particular to an engine timing gear cover having integral coolant flow passages.

2. Description of Related Art

The timing gear cover of the present invention is bolted to one end face of a cylinder block and provides a cover for the timing gear. The timing gear is disposed in a timing gear chamber that is formed by the face of the cylinder block and the timing gear cover. The timing gear cover is further formed with integral fittings for coupling the timing gear cover to a radiator for both discharging coolant to the radiator as well as receiving coolant from the radiator. The timing gear cover defines a water pump inlet chamber connected to the inlet coolant fitting that receives coolant from the radiator. The timing gear cover also forms a water pump outlet chamber that receives coolant from the water pump. The water pump outlet chamber communicates with a coolant inlet in the cylinder block for directing the coolant to the block. Coolant flows through the cylinder block and to the cylinder head in a known fashion and is discharged from the cylinder head to a hot coolant chamber also integrally formed in the timing gear cover. The hot coolant chamber communicates with the discharge coolant fitting in the cover for discharge of the coolant to the radiator. The discharge coolant fitting also houses the thermostat.

The timing gear cover is bolted to the cylinder block and is not bolted to the cylinder head. Accordingly, a resilient seal is placed between the cylinder head and timing gear cover to ensure a leak proof coupling therebetween.

The water pump is mounted to the front of the timing gear cover. The water pump receives coolant through an opening in the timing gear cover to the water pump inlet chamber. The outlet of the water pump is directed through another opening in the timing gear cover to the water pump outlet chamber for flow of coolant to the cylinder block.

The timing gear cover also includes a coolant bypass from the hot coolant chamber to the pump inlet chamber to allow coolant circulation through the engine prior to the thermostat opening. A novel aspect of the timing gear cover is the placement of the water pump inlet chamber between the water pump outlet chamber and the timing gear chamber. As a result, any leak of coolant from the higher-pressure water pump outlet chamber will flow into the lower pressure water pump inlet chamber. The coolant does not flow into the timing gear chamber where the coolant would contaminate the engine lubricating oil. This arrangement of the coolant chambers in the timing gear cover improves the reliability of the engine by eliminating or minimizing the likelihood of coolant leaks into the lubricating oil.

The integration of the thermostat housing into the timing gear cover with an integral bypass is another novel aspect of the invention.

DESCRIPTION OF THE PREFERRED EMBODIMENT

Figure 1:
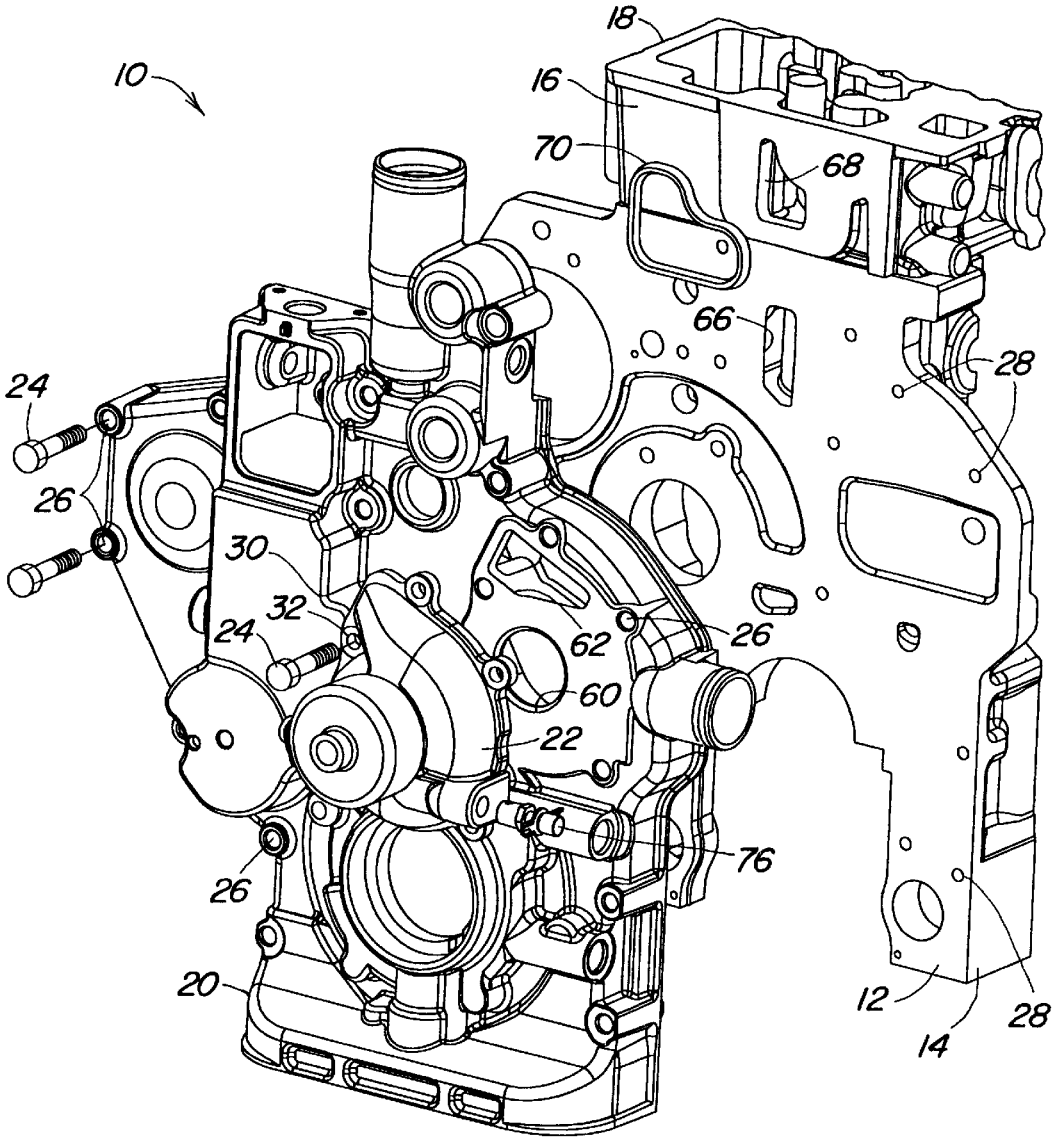
FIG. 1 is an exploded perspective view of the front portion of an internal combustion engine.

With reference to FIG. 1, the front portion of an internal combustion engine is shown. The engine is an inline, multiple cylinder engine. Shown is the front face 12 of the cylinder block 14 as well as the front face 16 of the cylinder head 18. The terms "front" and "rear" are used for purposes of explanation only and are not intended as limitations. Also shown are a timing gear cover 20 and a water pump 22. The timing gear cover is mounted to the block 14 by a plurality of bolts 24 that extend through apertures 26 in the timing gear cover and into threaded apertures 28 in the block 14. The water pump 22 includes a pump housing 30 that is mounted to the cover 20 by a some of the bolts 24 that extend through apertures 32 in the housing 30 and through apertures 26 in the timing gear cover and into the threaded apertures 28 in the block.

Figure 2:
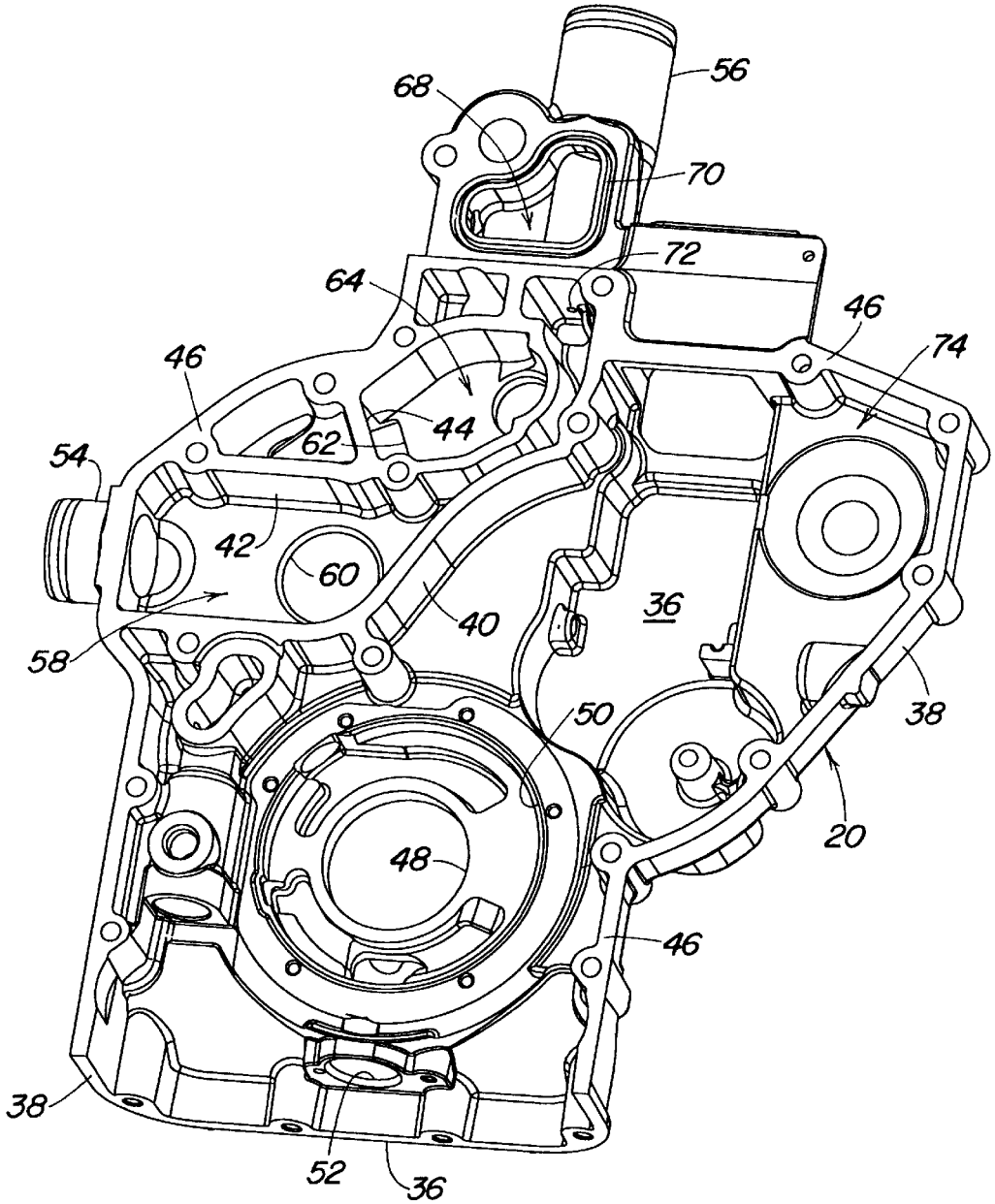
FIG. 2 is a perspective view of the rear or inside surface of the timing gear cover.

The timing gear cover 20 is shown in both FIG. 1 and FIG. 2. The timing gear cover is somewhat pan shaped, having a front wall 36 and an upstanding sidewall 38. Additional upstanding intermediate walls 40, 42 and 44 are provided in the interior of the timing gear cover to form various chambers as described below. The upstanding sidewall 38, as well as the upstanding intermediate walls 40, 42, 44 all form an inner face 46 of the timing gear cover. This inner face 46 engages the front face 12 of the block 14. A gasket (not shown) is placed between the timing gear cover face 46 and the block face 12 to form a seal therebetween.

The engine crankshaft extends through the aperture 48 in the timing gear cover. The oil pump (not shown) is placed in the circular boss 50 surrounding the aperture 48. The oil pump inlet is shown at 52.

The timing gear cover is integrally formed with a coolant inlet fitting 54 for connection to a hose to receive coolant from a radiator. The cover is also integrally formed with a coolant discharge fitting 56. The coolant discharge fitting 56 also serves as the thermostat housing and is the connection for a radiator hose to deliver coolant from the engine to the radiator.

The coolant inlet fitting 54 directs coolant into a water pump inlet chamber 58 that is defined by the upstanding intermediate walls 40, 42 as well as the cover front wall 36 and the front face of the engine block. Coolant flows from the chamber 58 through an aperture 60 into the water pump mounted to the opposite side of the wall 36. The pump returns the coolant through the opening 62 in the wall 36 and into a water pump outlet chamber 64. The chamber 64 is formed by the upstanding intermediate wall 42 as well as the upstanding sidewall 38, together with the front wall 36 and the block front face 12. Coolant flows from the chamber 64 into the engine block through the opening 66 in the front face of the block. The coolant then flows through the block, around the cylinders and then upward, into the cylinder head 18 in a conventional manner.

Coolant flows from the cylinder head 18 through an opening 68, and into a hot coolant chamber 68 in the cover 20. From the chamber 68 the coolant flows through the discharge fitting 56, past the thermostat (not shown) and back to the radiator. A resilient gasket 70 is mounted to the timing gear cover, in a seal groove surrounding the opening in to the chamber 68. The resilient gasket 70 is made of rubber or synthetic material capable of withstanding the high coolant temperatures without degradation. The resilient gasket 70 is required as the timing gear cover is bolted solely to the engine block, and is not bolted to the cylinder head.

A coolant bypass port 72 is formed in the wall between the hot coolant chamber 68 and the pump inlet chamber 58. This bypass allows coolant to circulate through the engine when the thermostat is closed.

The timing gear 20 includes a timing gear chamber 74 defined generally by the upstanding sidewalls 38 and the upstanding intermediate wall 40. The timing gear chamber 74 communicates with the engine lubricating oil used to lubricate the timing gear and chain. The timing gear cover is configured such that the lower pressure water pump inlet chamber 58 completely surrounds and separates the higher pressure water pump outlet chamber 64 from the timing gear chamber 74. Thus, any coolant leaking from the higher pressure chamber 64 will flow into the water pump inlet chamber rather than flowing into the timing gear chamber where the coolant would contaminate the lubricating oil. The arrangement of the coolant chambers in the timing gear cover improves the reliability of the engine 10 by reducing or eliminating the possibility of coolant leaking into the lubricating oil.

The water pump housing 30 includes a drain fitting 76 to enable coolant to be drained from the engine block and head. By placing the drain fitting 76 in the water pump housing, fewer machining operations in the block 12 are required. The drain fitting can be added to the smaller water pump housing at a lower cost.

Figure 3:
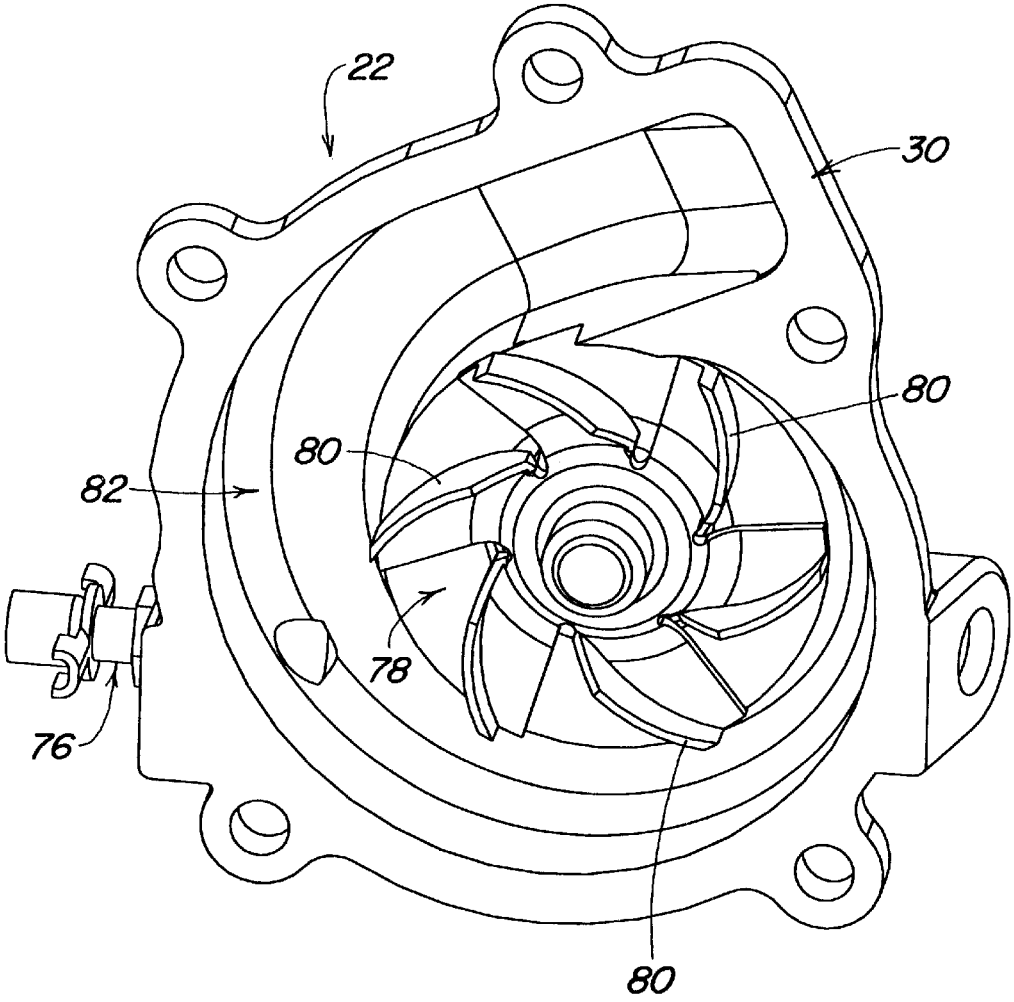
FIG. 3 is an enlarged perspective view of the water pump.

The water pump 22 is shown in greater detail in FIG. 3. The pump includes an impeller 78 having a plurality of vanes 80. The impeller 78 rotates in a clockwise direction as shown in FIG. 3 to move the coolant outward from the impeller and through the chamber 82 in the pump housing 30. The coolant then flows through the opening 68 in the timing gear cover to the water pump outlet chamber 64.

The timing gear cover provides an integral one-piece structure forming both the inlet and outlet fittings for coolant flow to and from the engine. In addition, the coolant flow path through the cover is designed for high reliability by isolating the higher-pressure pump outlet chamber from the timing gear chamber.

The invention should not be limited to the above-described embodiment, but should be limited solely by the claims that follow.

What is claimed is:

1. In an internal combustion engine having a cylinder block, a cylinder head and a timing gear cover, the cover and block cooperating to define a timing gear chamber, a water pump inlet chamber and a water pump outlet chamber separated from one another, the water pump inlet chamber being located between the water pump outlet chamber and the timing gear chamber whereby any coolant leak from the water pump outlet chamber must pass through the water pump inlet chamber before reaching the timing gear chamber.

2. The engine as defined by claim 1 wherein the cover is integrally formed with a coolant inlet fitting for receiving coolant from a radiator.

3. The engine as defined by claim 1 wherein the cover is integrally formed with a thermostat housing and a hot coolant chamber receiving coolant from the cylinder head and further comprising a gasket to seal between the cylinder head and the cover.

4. The engine as defined by claim 3 wherein the cover has a bypass passage for coolant flow from the hot coolant chamber to the water pump inlet chamber.

5. The engine as defined by claim 1 further comprising a water pump having a housing attached to an outer side of the timing gear cover, the water pump having a pump chamber, the timing gear cover having a first opening therethrough from the water pump inlet chamber to the pump chamber and a second opening therethrough from the pump chamber to the water pump outlet chamber.

6. The engine as defined by claim 5 further comprising a coolant drain port in the water pump housing.

7. An internal combustion engine comprising:

a cylinder block;

a cylinder head;

a one piece timing gear cover having a coolant inlet fitting and a coolant discharge fitting to couple the cover to a radiator to discharge and receive coolant to and from the radiator, the timing gear ever being attached to the cylinder block by a plurality of bolts;

a resilient compressible gasket forming a seal between the cylinder head and the timing gear cover, the resilient compressible gasket being compressed solely by the bolts attaching the timing gear cover to the cylinder block;

a water pump coupled to the cover;

the cylinder block, the cylinder head, the timing gear cover and the water pump defining a coolant circulation path through the engine between the inlet and outlet fittings of the timing gear cover.

8. An internal combustion engine comprising:

a cylinder block;

a cylinder head;

a one piece timing gear cover having a coolant inlet fitting and a coolant discharge fitting to couple the cover to a radiator to discharge and receive coolant to and from the radiator, the timing gear cover and the cylinder block forming a water pump inlet chamber, the timing gear cover including a thermostat housing having a chamber for hot coolant from the cylinder head and a bypass passage between the thermostat housing chamber and the water pump inlet chamber; and a water pump coupled to the cover;

the cylinder block, the cylinder head, the timing gear cover and the water pump defining a coolant circulation path through the engine between the inlet and outlet fittings of the timing gear cover.

9. An internal combustion engine comprising:

a cylinder block;

a cylinder head;

a one piece timing gear cover having a coolant inlet fitting and a coolant discharge fitting to couple the cover to a radiator to discharge and receive coolant to and from the radiator; and a water pump coupled to the cover, the water pump including a housing having a coolant drain port therein;

the cylinder block, the cylinder head, the timing gear cover and the water pump defining a coolant circulation path through the engine between the inlet and outlet fittings of the timing gear cover.

10. An internal combustion engine comprising:

a cylinder block having a front face; and a timing gear cover having a front wall spaced from the front face of the cylinder block, an upstanding sidewall and upstanding intermediate walls cooperating to define an inner face adapted to be placed adjacent the front face of the cylinder block with the front wall of the timing gear cover spaced from the front face of the cylinder block, the upstanding sidewall and upstanding intermediate walls defining a water pump inlet chamber, a water pump outlet chamber and a timing gear chamber separated from one another by the intermediate walls with the water pump inlet chamber disposed between and separating the water pump outlet chamber from the timing gear chamber.

11. The engine as defined by claim 10 wherein the cover is integrally formed with a coolant inlet fitting for receiving coolant from a radiator.

12. The engine as defined by claim 10 further comprising a cylinder head coupled to the cylinder block and wherein the timing gear cover is integrally formed with a thermostat housing and a hot coolant chamber receiving coolant from the cylinder head and further comprising a gasket to seal between the cylinder head and the timing gear cover.

13. The engine as defined by claim 12 wherein the timing gear cover has a bypass passage for coolant flow from the hot coolant chamber to the water pump inlet chamber.

14. The engine as defined by claim 10 further comprising a water pump having a housing attached to an outer side of the timing gear cover front wall, the water pump having a pump chamber, the timing gear cover having a first opening through the front wall from the water pump inlet chamber to the pump chamber and a second opening through the front wall from the pump chamber to the water pump outlet chamber.

15. The engine as defined by claim 14 further comprising a coolant drain port in the water pump housing.

* * * * *